United States Patent [19]

Eschauzier et al.

[11] Patent Number: 5,022,296

[45] Date of Patent: Jun. 11, 1991

[54] METHOD AND APPARATUS FOR THE AUTOMATIC MANUFACTURE OF PORTIONS OF A GIVEN LENGTH OF STRIP MATERIAL HAVING A REPETITIVELY PATTERNED SURFACE

[75] Inventors: Francois R. Eschauzier, Hendrik Ido Ambacht; Guy H. Lim, Rotterdam, both of Netherlands

[73] Assignee: Hunter Douglas International N.V., Willemstad, Netherlands

[21] Appl. No.: 464,471

[22] Filed: Jan. 12, 1990

[30] Foreign Application Priority Data

Jan. 13, 1989 [GB] United Kingdom ..... 8900771
Mar. 17, 1989 [GB] United Kingdom ..... 8906238

[51] Int. Cl.[5] ..... B26D 5/20

[52] U.S. Cl. ..... 83/27; 83/60; 83/247; 83/263

[58] Field of Search ..... 83/363, 367, 354, 23, 83/270, 58, 60, 62, 263, 262, 268, 241, 247, 63, 72; 160/236, 405; 364/470.09

[56] References Cited

FOREIGN PATENT DOCUMENTS

| | | | |
|---|---|---|---|
| 3122871 | 3/1982 | Fed. Rep. of Germany | 160/405 |
| WO85/04687 | 10/1985 | Sweden . | |
| 713802 | 8/1954 | United Kingdom . | |
| 2124285 | 2/1984 | United Kingdom | 160/405 |
| 2197374 | 5/1988 | United Kingdom . | |

*Primary Examiner*—Douglas D. Watts
*Assistant Examiner*—Kenneth E. Peterson
*Attorney, Agent, or Firm*—Pennie & Edmonds

[57] ABSTRACT

A method and apparatus for the automatic manufacture of portions of a given length of strip material printed or embossed with a repetitive pattern in a longitudinal strip material, such as venetian blind slats, panels for walls and ceiling coverings and for shutters, awnings and sun louvres, in which the strip material is fed progressively to a cutting unit, first sections are cut, each of said given length, on the strip material, the second sections are cut from parts of the strip material immediately following at least some of the cut-off first sections, in a controlled manner, to allow varying of the length of each of said second sections individually, to provide a controlled positioning of the repetitive pattern along the length of the subsequently cut first sections, the second sections being rejected and the first sections being renewed for further handling.

22 Claims, 4 Drawing Sheets

METHOD AND APPARATUS FOR THE AUTOMATIC MANUFACTURE OF PORTIONS OF A GIVEN LENGTH OF STRIP MATERIAL HAVING A REPETITIVELY PATTERNED SURFACE

The present invention relates to method and apparatus for the automatic manufacture of portions of a given length of strip material printed or embossed with a repetitive pattern in the longitudinal direction of the strip material. Such portions include venetian blind slats and panels for wall and ceiling coverings and for shutters, awnings and sun louvres.

Venetian blinds are manufactured with a variety of decorations and finishes, often applied to the slats thereof, which, being formed of a substantially flat or slightly crowned material, are easily printed upon. The slats are usually cut from a continuous strip material and fed straight into an automatic assembling machine. A repetitive design is usually applied to the continuous strip before it is cut into slats and the slats assembled. Similarly predetermined lengths of profiled material are cut before these are assembled into a surface or surface covering for building walls or openings, such as wall or ceiling coverings. If the repetition length of the pattern, for example, 1000 mm, is similar but not the same as the length of each slat, in the case of a venetian blind for example, 1010 mm, the assembled blind shows an additional secondary pattern, in this case a slanting pattern, between repetitions of the preprinted pattern on adjacent slats. This secondary pattern is often undesirable, especially in the case where the preprinted pattern is a marble or wood grain effect, and spoils the visual effect of the preprinted pattern. One method of avoiding such a secondary pattern is to scramble the slats by hand before they are fed into an automatic blind assembly machine. However, such a process is time consuming and expensive and negates the advantages of having an automatic combined cutting and assembly machine.

It may also be desirable for the assembled blind to show a secondary pattern different from that which would occur if the cut slats were simply assembled in the order they left the cutting machine Similar considerations could apply in the production of wall and ceiling panels and for awning and sun louvre panels which are decorated with a repetitive pattern.

According to the present invention there is provided a method for the automatic manufacture of a predetermined number of portions of a given length of strip material from a supply of strip material having a patterned surface, with the pattern being repetitive in the longitudinal direction of the strip material, said method comprising the steps of:

progressively feeding said strip material to a cutting unit;

cutting first sections, each of said given length, from said strip of material;

cutting second sections from parts of said strip material immediately following at least some of said cut-off first sections, in a controlled manner, to allow the varying of the length of each of said second sections individually, to provide a controlled positioning of the repetitive pattern along the length of the subsequently cut first sections;

rejecting said second sections; and removing said first sections for further handling.

By using the method of the present invention, secondary patterns in the assembled blind or assembled panelling, for example, may be eliminated or modified as desired to obtain a pleasing finish. The cutting of the respective second sections in respect of the repetitive pattern of the strip material is automatically controlled and performed so as to avoid or to the contrary arrange for a secondary pattern to appear in a direction transverse to the longitudinal direction of subsequently produced first sections upon arrangement thereof in the same sequence into parallel side by side relation to form a preferably decorative covering surface. This may be done without substantially slowing down and without major modification of the subsequent further handling such as an assembly process, in the case of the manufacture of venetian blinds.

Also according to the invention there is provided a strip material cutting apparatus for cutting portions of a given length of strip material from a supply of strip material having a patterned surface, with the pattern being repetitive, in the longitudinal direction of the strip material, said apparatus comprising:

feed means for feeding said strip material;

interrupting means for interrupting feeding of said strip material;

cut-off means for cutting said strip of slat material into first and second cut sections;

rejection means for rejecting said second cut sections;

removing means for removing first cut sections for further handling; and control means connected to said interrupting means, said cut-off means, said removing means and said rejection means said control means being effective to control said interrupting means, said cut-off means, said removing means and said rejection means so as to cut first sections of a first predetermined length from said strip of material and remove said first sections and to cut said second sections from said strip of slat material and reject said second sections, to provide a controlled positioning of the repetitive pattern along the length of the cut first sections.

When manufacturing panelling, the cutting of the second sections may, if desired, be controlled and performed so that the differences in pattern of at least a certain number of subsequent first sections creates a specific predetermined decorative composition when said certain number of subsequent first sections are parallely arranged to form a surface.

The second cut sections may have a predetermined fixed length, or have a variably or random length. Furthermore a variably, random or predetermined number of such second sections may be cut between adjacent first sections. If it is desired to eliminate any secondary pattern in the assembled blind, or panelling, the second sections are cut with random length, or a random number are cut, or possibly both. If a particular secondary pattern is desired the length and number of the second sections cut may be fixed or may vary according to a predetermined formula.

The rejected second sections may either be scrapped or may in some cases be recycled into the production of the continuous strip or might alternatively be used as samples for promotional purposes.

In order that the present invention may more readily be understood, the following description is given, merely by way of example, reference being made to the accompanying drawings in which.

Figure 2:
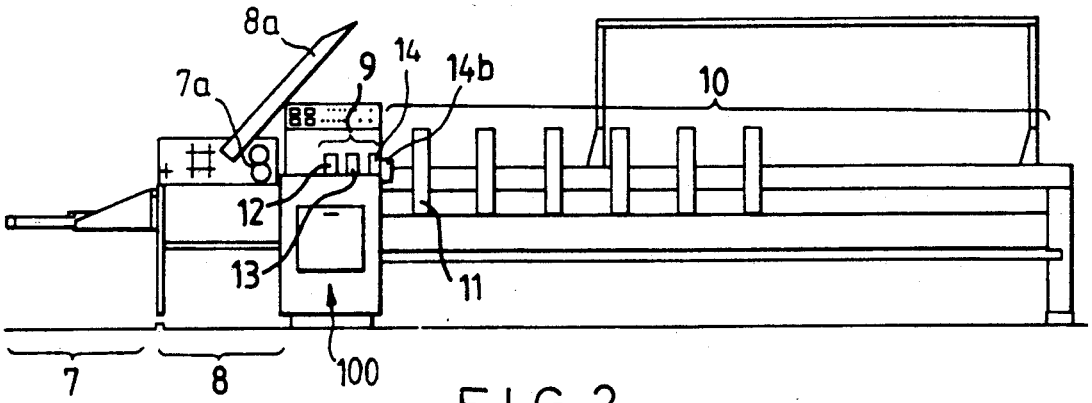
FIG. 2 is a front elevation of a conventional venetian blind assembly apparatus.
Figure 3:
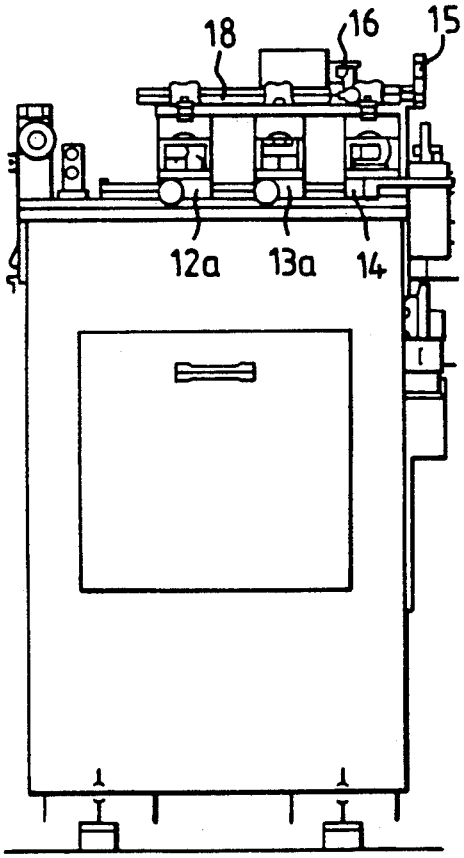
FIG. 3 is a front elevation of a first embodiment of the present invention, using a modified disc section of a conventional apparatus.
Figure 4:
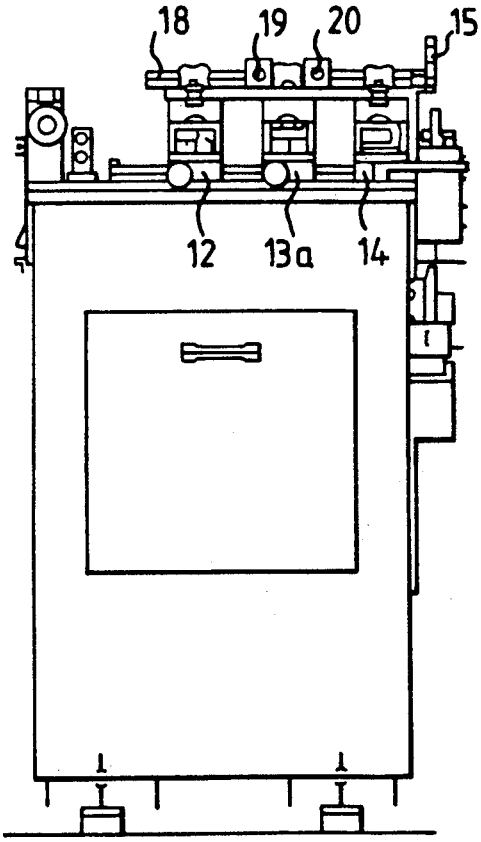
FIG. 4 is a front elevation of a second embodiment of the present invention.

Referring to FIG. 2, a conventional venetian blind assembly machine includes a strip supply section 7, a forming section 8 for profiling the strips, an accumulator 8*a*, a die section 9 and a lacing section 10. The die section 9 includes a left punch die 12, a cut off die 13 and a right punch die 14. As can be seen in FIGS. 3 and 4 strip material is fed by feed means in the form of feed roller shown schematically at 7*a*.

Figure 1:
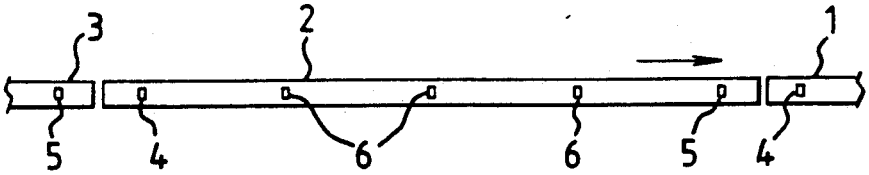
FIG. 1 is a schematic view showing how slats are cut from a continuous strip of slat material in a conventional venetian blind assembly apparatus.

The normal operation of a conventional venetian blind assembly will be described with reference to FIGS. 1 and 2.

It can be seen that the left-hand punch die 12, the cut-off die 13 and the right-hand punch die 14 are all activated simultaneously to cut off a slat 1 while punching the left-end hole 4 of slat 1 and the right-end hole 5 of the next slat 2. The slat feed roller is stopped and the cut-off slat is fed out of the dies by a feed-out motor and fed to the lacing section, which comprises a number of appropriately activated lacing stations. The feed roller is then restarted and the continuous strip of slat material fed until it reaches a first stop. The right-hand punch die 14 is then activated separately to punch an intermediate hole 6 in the slat. This procedure is repeat, until the appropriate number of intermediate holes for the length of slat desired have been punched. When the continuous strip material has been fed a length equivalent to one slat, all three dies are activated simultaneously to cut off slat 2 and punch the left-end hole 4 of this slat and the right-end hole 5 of the slat 3, the process now repeats. In this conventional venetian blind assembly machine, the two punch dies 12, 14 and the cut-off die 13 are all activated by a single camshaft similar to camshaft 18 of FIG. 3. Crank 15 is associated with camshaft 18 to operate the dies 12*a*, 13*a* and 14 via a drive shaft (not shown). The cut strip is removed by downstream feed means 24*b* to the lacing section 10.

Figure 5:
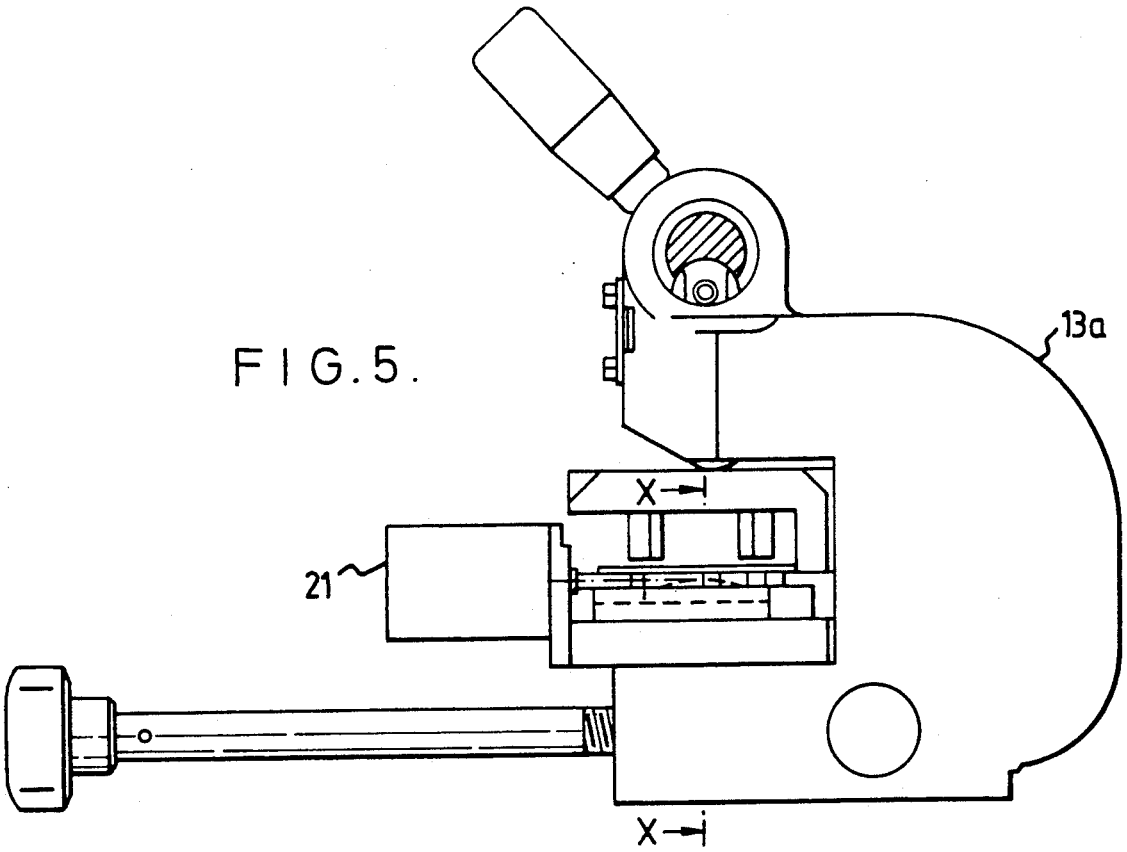
FIG. 5 is a side elevation of a cut off die modified according to the first or second embodiment of the present invention.
Figure 6:
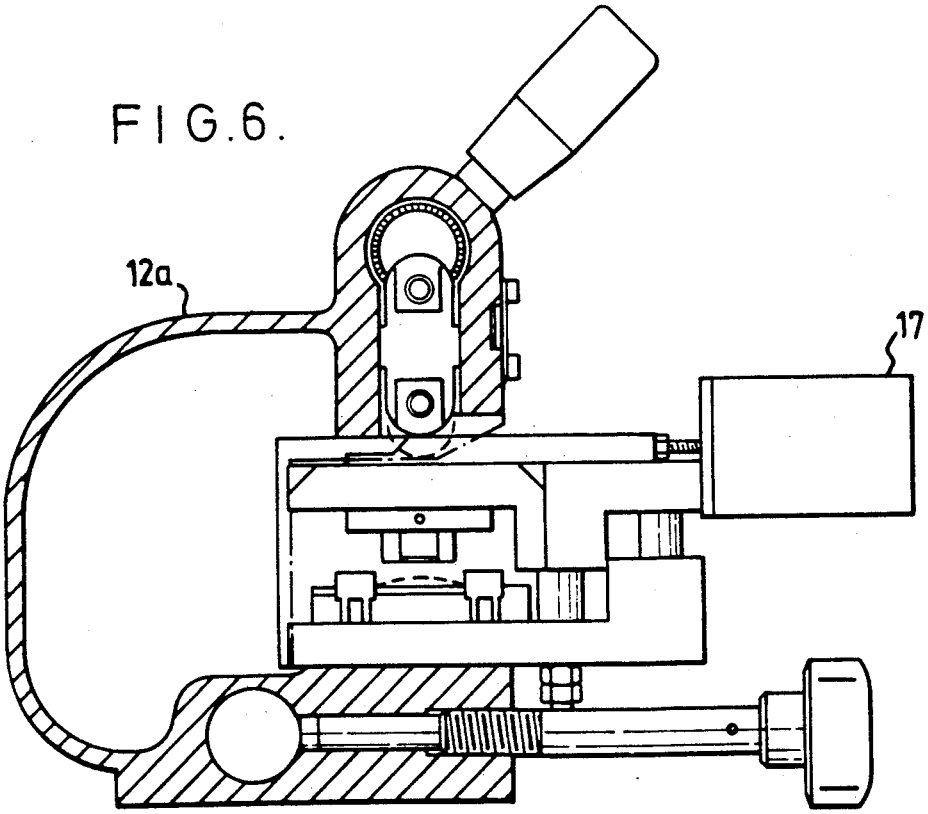
FIG. 6 is a partly cross-sectioned side view of a left punch die of the first embodiment of the present invention.
Figure 10:
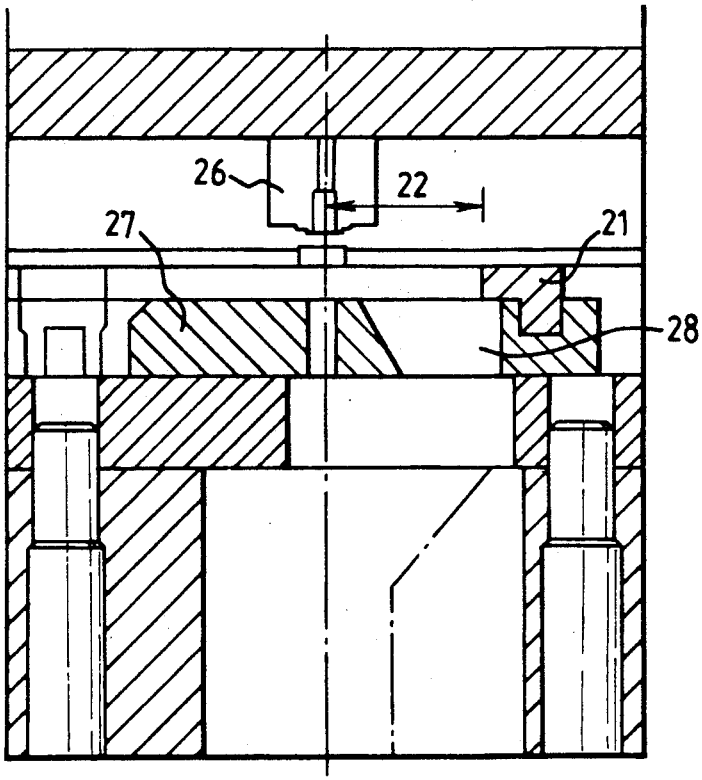
FIG. 10 is an enlarged cross-section along line X—X of FIG. 5.

In a first embodiment of the present invention as generally illustrated in FIG. 3, the following modifications are made to a conventional apparatus:

punch die 12*a* is provided with a solenoid activated mechanism 17, see FIG. 6;

cut-off die 13*a* is milled at its lower die part 27, as indicated at 28, to reject and facilitate the dropout of short pieces of slat material and is provided with a solenoid activated stop mechanism 21, see FIGS. 5 and 10. This acts as an interrupting means to interrupt feed of the strip material.

The control system shown schematically at 100 for this machine is also modified.

In the first embodiment, the second sections are of a fixed predetermined length, equal to the distance 22, between the cut-off nipple 26 and the stop mechanism 21 in FIG. 10, and the control system 100 is adapted to cause the cut-off die 13*a* to cut a variable or random number of second sections between adjacent first sections which form the slats.

Figure 9:
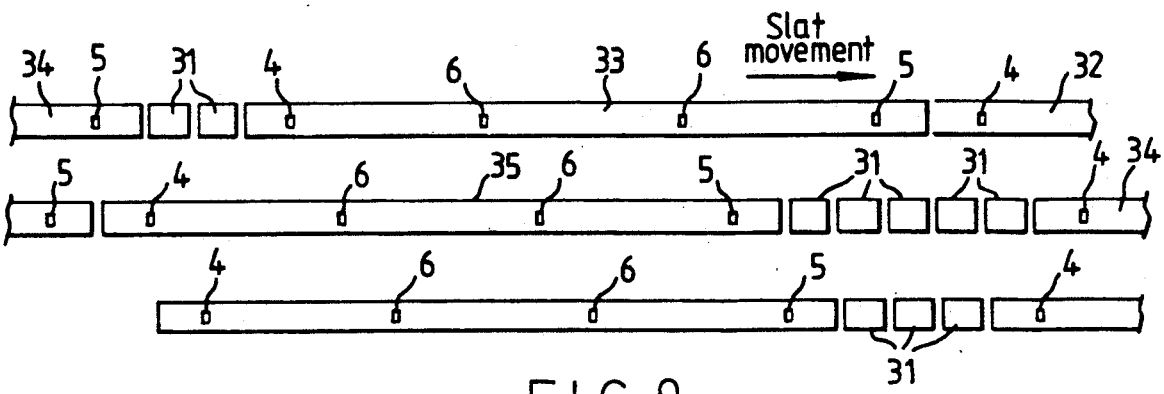
FIG. 9 is a schematic diagram showing how slats are cut from a continuous strip of slat material in one form of venetian blind assembly machine according to the present invention.

The operation of this apparatus in a random pattern mode will be described with reference to FIG. 9. At the end of slat 32 and beginning of slat 33, all three dies are activated simultaneously to punch the right-end hole 5 of slat 32, the left-end hole 4 of slat 33 and to cut off slat 32. As the strip material is fed, punch die 14 is activated twice at appropriate locations to punch the intermediate holes of slats 33. At this point dies 12*a*, 13*a* are disengaged from the camshaft device by a clutch 16. At the end of slat 33, cut-off die 13*a* and punch die 14 are activated to punch the end hole of slat 33 and cut it off. Cut-off die 13*a* and the stop mechanism 21, are activated to cut off a single short piece of slat material 31. Punch die 12*a*, cut-off die 13*a* and the stop mechanism 21 are then activated together to cut off a further short piece 31 and to punch the end hole of slat 34. Punch die 14 is then activated twice again at appropriate points to cut the intermediate holes of slat 34. At the end of slat 34, cut-off die 13*a* and punch die 14 are activated to cut the end hole 4 of slat 34, and to cut slat 34 off the continuous strip of slat material. Cut-off die 13*a* and the stop mechanism 21 are then activated four times to cut off four short pieces of slat material 31. Next punch die 12*a*, cut-off die 13*a*, and the stop mechanism 21 are activated to cut off a fifth short piece of strip material and punch the left-end hole of slat 35.

As can be readily seen, the number of short pieces of slat material 31 cut off between adjacent slats may be easily varied in a random manner so as to eliminate any secondary patterns in the assembled blind.

In the second embodiment of the present invention, of FIG. 4, the cut-off die 13*a* is milled and provided with a solenoid activated stop mechanism 21 as before, see FIGS. 5 and 10. However, the camshaft is provided with two solenoid activated clutches 19, 20 placed either side of the cut-off die 13*a*. This embodiment then operates as described above. The left-hand punch die 12 can remain substantially unmodified.

Figure 7:
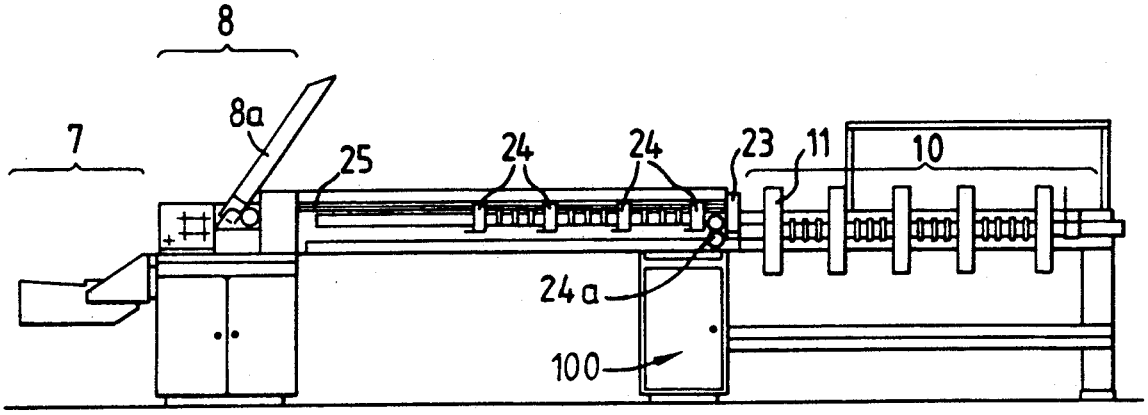
FIG. 7 is a front view of an alternative type of assembly apparatus incorporating a third embodiment of the present invention.
Figure 8:
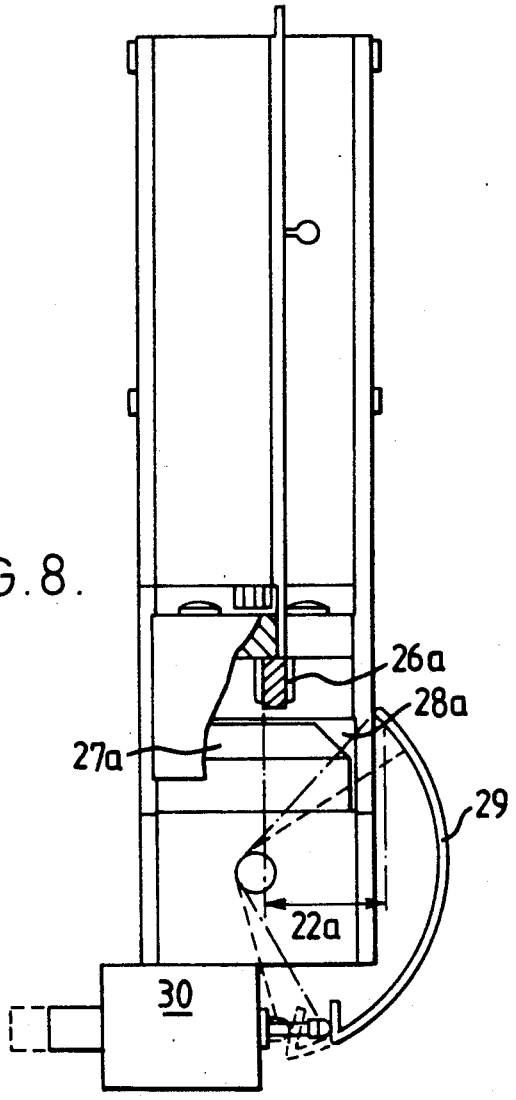
FIG. 8 is a front view of a cut off die of the third embodiment of the present invention.

The third embodiment of the present invention, shown in FIG. 7 in which previously used numerals denote like parts, has an electrically activated cut-off die 23, which is controlled separately from the punch dies 24, which are driven by a camshaft 25, it is therefore only necessary to mill the cut-off die 23 and add a stop mechanism comparable to the mechanism of the previous embodiments. The right-hand most or downstream of the punch dies 24 has associated therewith a feed means 24*a* which acts to draw the strip material through the apparatus. The feed means 24*a* thus act firstly as means to feed the strip material to punches 24 and second as withdrawal means to feed the cut strip to section 10. The cut-off die 23, shown in FIG. 8, includes a cut-off nipple 26*a*, a lower die part 27*a* from which a section 28a is milled out. To this is added a swiveling end stop 29 activated by a solenoid 30. This embodiment may then cut off short portions of slat material of length equal to the distance 22a, and to adapt the control system in order for this apparatus to function according to the present invention.

The end stop shown, is merely one example of the many varieties of end stops that might be employed in an embodiment of the invention; it would also be possible to position the end stop at any position between the cut-off and the first lacing station, or to employ several end stops, or even an end stop of variable position. The end stop might also be hydraulically or pneumatically controlled rather than electrically operated.

Alternatively, or additionally, the feed means could be controlled to interrupt the feeding of the strip material e.g. by having a controlled operation of a feed motor or of a clutch or of the position of feed rollers (or a linearly movable feed member) into or out of contact with the strip material.

Although the invention has been generally described and explained with reference to a venetian blind slat cutting apparatus it should be understood that the inventive concept is not limited to this particular field of application. Specifically the production of profiled members or panels for forming ceilings, walls, awnings, shutters and sun louvres are all within the scope of the invention.

We claim:

1. A method for the automatic manufacture of a predetermined number of portions of a given length of strip material from a supply of strip material having a patterned surface, with the pattern being repetitive in the longitudinal direction of the strip material, said method comprising the steps of:

progressively feeding said strip material longitudinally to a cutting unit;

cutting first sections, each of said given length, from said strip material;

removing a variable amount of said strip material immediately following at least some of said cut-off first sections, in a controlled manner to provide a controlled positioning of the repetitive pattern along the length of the subsequently cut first sections; and removing said first sections for further handling.

2. A method as claimed in claim 1, wherein the removing of a variable amount is controlled and performed so that the differences in pattern of at least a certain number of subsequent first sections creates a specific predetermined decorative composition when said certain number of subsequent first sections are parallely arranged to form a surface.

3. A method as claimed in claim 1, wherein said step of removing a variable amount of said strip material comprises cutting said variable amount after said first sections; and separating said variable amount from said first sections.

4. A method as claimed in claim 1, wherein said portions are of a second predetermined length.

5. A method as claimed in claim 1, wherein said variable amount comprises one or more portions, each portion being cut separately from the strip material.

6. A method as claimed in claim 1 and further comprising the step of profiling the strip material before feeding it to said cutting unit.

7. A method as claimed in claim 1, wherein said strip material is venetian blind slat material whereby the cut-off first sections will form venetian blind slats.

8. A method as claimed in claim 7, further comprising the step of punching holes in said first sections so as to provide venetian blind slats with holes.

9. A method as claimed in claim 7, wherein the step of removing the first sections for further handling comprises feeding the venetian blind slats formed by said first sections to a venetian blind assembly machine.

10. A strip material cutting apparatus for cutting portions of a given length of strip material from a supply of strip material having a patterned surface, with the pattern being repetitive in the longitudinal direction of the strip material, said apparatus comprising:

feed means for feeding said strip material;

interrupting means for interrupting feeding of said strip material;

cut-off means for cutting said strip material into portions;

means for separating undesired portions;

removing means for removing desired portions for further handling;

control means connected to said interrupting means, said cut-off means and said removing means, said control means being effective to control said interrupting means, said cut-off means and said removing means so as to cut first sections of a first predetermined length from said strip of material and remove said first sections for further handling and to cut variable amounts from said strip material to be separated as undesired portions, to provide a controlled positioning of the repetitive pattern along the length of the cut first sections; and a plurality of punch dies used for punching holes in said strip material and wherein said control means is further adapted to control each said punch die to punch holes in said first sections.

11. A strip material cutting apparatus for cutting portions of a given length of strip material from a supply of strip material having a patterned surface, with the pattern being repetitive, in the longitudinal direction of the strip material, said apparatus comprising:

feed means for feeding said strip material;

interrupting means for interrupting feeding of said strip material;

cut-off means for cutting first sections from said strip material and a variable amount of said strip material immediately after at least some of said first sections;

means for separating said variable amounts from said first sections;

removing means for removing first cut sections for further handling; and control means connected to said interrupting means, said cut-off means, and said removing means, said control means being effective to control said interrupting means, said cut-off means, and said removing means so as to cut first sections of a first predetermined length from said strip material and remove said first sections and to cut said variable amounts from said strip material and separate said variable amounts, to provide a controlled positioning of the repetitive pattern along the length of the cut first sections.

12. An apparatus as claimed in claim 11, wherein said control means are further effective to control said at least one feed means, said interrupting means and said cut-off means, so as to cut a number of portions, each portion being separately cut, said portions collectively forming said variable amounts.

13. An apparatus as claimed in claim 11, wherein said interrupting means comprises at least one retractable stop mounted downstream of said cut-off means.

14. An apparatus as claimed in claim 11, wherein said interrupting means comprises means to stop said feed means from feeding said strip material.

15. An apparatus as claimed in claim 11, further comprising a plurality of punch dies used so as to punch holes in said strip material and wherein said control means is further adapted to control each said punch die to punch holes in said first sections.

16. An apparatus as claimed in claim 11 and further comprising a camshaft operatively connected to said control means effective to activate said punch dies.

17. An apparatus as claimed in claim 16, wherein said cut-off means comprising a cut-off die connected to said camshaft, and said plurality of punch dies are controllably disengagable from said camshaft under the control of said control means.

18. An apparatus as claimed in claim 10, wherein all of said punch dies are upstream relative to the direction of feed of said strip material of said cut-off means.

19. An apparatus as claimed in claim 10, wherein one of said plurality of punch dies is downstream of said cut-off means, and the remainder of said plurality of punch dies are upstream of said cut-off means.

20. A method for the automatic manufacture of a predetermined number of portions of a given length of strip material from a supply of strip material having a patterned surface, with the pattern being repetitive in the longitudinal direction of the strip material, said method comprising the steps of:

progressively feeding said strip material to a cutting unit;

cutting first sections, each of said given length, from said strip material;

removing a variable amount of said strip material immediately following at least some of said cut-off first sections in a controlled manner provide a controlled positioning of the repetitive pattern along the length of the subsequently cut first sections, wherein said variable amount comprises one or more portions of equal length cut separately from the strip of slat material;

separating said portions from the first sections; and removing said first sections for further handling.

21. A method for the automatic manufacture of a predetermined number of venetian blind slats having a given length from a supply of venetian blind slat material having a patterned surface, with the pattern being repetitive in the longitudinal direction of the slat material, said method comprising the steps of:

progressively feeding said slat material longitudinally to a cutting unit;

cutting first sections, each of said given length, from said material to form venetian blind slats;

removing a variable amount of said strip material immediately following at least some of said cut-off first sections in a controlled manner to provide a controlled positioning of the repetitive pattern along the length of the subsequently cut first sections;

rejecting said second sections; and removing said first sections for further handling.

22. A method as claimed in claim 21, further comprising punching holes in said first sections; and wherein said further handling of the first sections comprises feeding the venetian blind slats formed thereby to a blind assembling machine.

* * * * *

UNITED STATES PATENT AND TRADEMARK OFFICE
CERTIFICATE OF CORRECTION

PATENT NO. : 5,022,296

DATED : June 11, 1991

INVENTOR(S) : ESCHAUZIER et al.

It is certified that error appears in the above-identified patent and that said Letters Patent is hereby corrected as shown below:

ON THE TITLE PAGE: under item "[73] Assignee", after "Willemstad," insert -- Curacao, -- and after "Netherlands" insert -- Antilles --.

Signed and Sealed this

Ninth Day of February, 1993

*Attest:*

STEPHEN G. KUNIN

*Attesting Officer*

*Acting Commissioner of Patents and Trademarks*